US008777028B2

(12) United States Patent
Sakulsacha

(10) Patent No.: US 8,777,028 B2
(45) Date of Patent: Jul. 15, 2014

(54) SPOUT FOR DRINKING CONTAINER

(75) Inventor: Chawarin Sakulsacha, Bangkok (TH)

(73) Assignee: Royal King Infant Products Co. Ltd., Bangkok (TH)

( * ) Notice: Subject to any disclaimer, the term of this patent is extended or adjusted under 35 U.S.C. 154(b) by 0 days.

(21) Appl. No.: 13/620,759

(22) Filed: Sep. 15, 2012

(65) Prior Publication Data

US 2013/0068715 A1 Mar. 21, 2013

Related U.S. Application Data

(60) Provisional application No. 61/535,544, filed on Sep. 16, 2011.

(51) Int. Cl.

| | |
|---|---|
| ***A61J 11/00*** | (2006.01) |
| ***A61J 11/02*** | (2006.01) |
| ***A47G 19/22*** | (2006.01) |
| *A61J 11/04* | (2006.01) |

(52) U.S. Cl.

CPC ..... *A47G 19/2272* (2013.01); *A61J 11/02* (2013.01); *A61J 11/045* (2013.01); *A61J 11/0065* (2013.01)

USPC ..... 215/11.4; 215/11.5

(58) Field of Classification Search

USPC ..... 215/11.1, 11.4, 11.5

See application file for complete search history.

(56) References Cited

U.S. PATENT DOCUMENTS

| | | | | |
|---|---|---|---|---|
| 1,545,436 | A | 7/1925 | McGeary | |
| 1,656,157 | A | 1/1928 | Correnti | |
| 2,223,179 | A | 8/1937 | Lougheed | |
| 2,980,113 | A | 6/1961 | Sappey et al. | |
| 2,989,961 | A | 6/1961 | Blanchett | |
| 3,113,569 | A | 12/1963 | Barr et al. | |
| 3,532,242 | A | 10/1970 | Tibbs | |
| D294,735 | S | 3/1988 | Morano et al. | |
| 4,993,568 | A | 2/1991 | Morifuji et al. | |
| 5,101,991 | A | 4/1992 | Morifuji et al. | |
| D330,938 | S | 11/1992 | Sakashita | |
| 5,439,143 | A | 8/1995 | Brown et al. | |
| 5,769,285 | A | 6/1998 | Upham et al. | |
| 5,784,999 | A | 7/1998 | Larson et al. | |
| 5,881,893 | A | 3/1999 | Manganiello | |
| 6,957,744 | B2 | 10/2005 | Holley, Jr. | |
| 6,994,225 | B2 * | 2/2006 | Hakim | 215/11.4 |
| 7,540,388 | B2 | 6/2009 | Silver | |
| 7,637,383 | B2 | 12/2009 | Schlumpf | |
| 8,215,504 | B2 | 7/2012 | Marr et al. | |
| 2006/0201902 | A1 * | 9/2006 | Brown et al. | 215/11.4 |
| 2012/0074090 | A1 * | 3/2012 | Rees | 215/11.1 |

* cited by examiner

*Primary Examiner* — Mickey Yu
*Assistant Examiner* — Allan Stevens
(74) *Attorney, Agent, or Firm* — ZIP Law PLLC; Claire Zopf

(57) ABSTRACT

A spout for attachment to bottles, cups or other drinking vessels and containers having a dome shaped enclosure and a set of stability ribs. The stability ribs specifically ensuring that fluid flow through the fluid conduit remains as laminar as possible, and prevents the fluid conduit from collapse if a high amount of suction or mastication is provided by a user of the drinking vessel or container.

6 Claims, 5 Drawing Sheets

SPOUT FOR DRINKING CONTAINER

This application claims the benefit of U.S. Provisional Application No. 61/222,361 filed Sep. 16, 2011 and entitled Spout for Drinking Container, which is hereby incorporated herein by reference in its entirety.

FIELD OF THE INVENTION

The present invention is related to a spout for attachment to bottles, cups or other drinking vessels and containers.

BACKGROUND OF THE INVENTION

Spouts and nipples facilitate the extraction of fluids from a drinking container for infants and small children, sometimes even adults, where the sucking motion of the mouth draws liquid out of the container and through the spout or nipple. Spouts can be hard or soft spouts, where soft spouts often consist of an elastic material, for example rubber or silicone, and can be attached as is conventionally known, to and around an opening in the container by using for example a threaded cap which secures a flange of the spout between the container and the cap.

The spout or nipple is commonly formed as an inverted funnel shape with the flat, radially extending flange for attachment to a bottle opening and an intermediate transition area defined by sidewalls which direct the liquid in the container towards the tip of the spout. The intermediate transition area extends towards the tip which is generally enclosed having one or more slits, pin holes, valves or passages where fluid flows from the container and spout as the user provides suction or a vacuum by sucking on the spout or nipple. As described for example in US Patent Publication No. US2009/0039046, to Man et al., "since the drinking slot is located in an outwardly bulged end region of the bottle teat the withdrawal of food requires that suction work be done." Man et al. describes one or more drinking slots that are perpendicular to the sidewalls of the bottle teat. By increasing the number of drinking holes or slots or using X- or Y-shaped notches or other shapes within the small recess of the suction nipple area between the sidewalls throughput is increased. However, the location and shape of such slits and notches also diminishes the effectiveness of no-spill properties that prevent leakage of the contents of the container when not in use. Accordingly a higher throughput spout with improved no-spill effectiveness is needed.

OBJECT AND SUMMARY OF THE INVENTION

Accordingly, it is the object of the invention to provide a soft drinking spout for a bottle or cup that enables an increased flow of liquid or food with a structure and form that facilitates opening of a slit or passage in the spout based on a user's natural oral suction process, while also providing in an efficient way for adequate closing of the slit(s) or passage(s) in the spout preventing any unintentional spilling of fluid or food.

Another object of the invention is to provide the soft drinking spout of an elastic material having at least one slit passage that is easy to manufacture and in combination with the structure and form of the soft spout, rapidly controls flow from the container in drinking situations.

It is still another object of the present invention to provide the soft spout having at least one ventilation valve that provides for the induction of air back into the container during drinking situations where the user is sucking liquid from the container through the spout.

Yet another object of the invention is to provide a form and structure which permits the liquid passages in the soft spout to easily close and remain closed in non-drinking situations so that the spout does not leak.

Another object of the invention is to form a series of inner rib supports which prevent collapsing of the sidewalls of the spout during drinking situations.

Yet still another object of the invention is to form a pair of opposing lips which extends substantially higher than the liquid passages in the spout and which move about a hinge axis substantially aligned with the liquid passages so that the moment of the lips moving about the hinge axis facilitates the opening and closing of the liquid passages.

The present invention is directed to a fluid conduit for drinking containers, comprising a flange for attachment to a container, a domed enclosure extending from the flange, a first and second sidewall extending from the domed enclosure, and wherein the first and second sidewalls form a spout tip.

The present invention is further directed to a method of making a fluid conduit for drinking containers, comprising the steps of forming a flange for attachment to a container, extending a domed enclosure from the flange, extending a first and second sidewall from the domed enclosure, and forming the first and second sidewalls into a spout tip.

These and other features, advantages and improvements according to this invention will be better understood by reference to the following detailed description and accompanying drawings.

BRIEF DESCRIPTION OF THE DRAWINGS

The invention will be described in more detail below with reference to the accompanying drawings. In the drawings.

DESCRIPTION OF THE PREFERRED EMBODIMENTS

Figure 1:
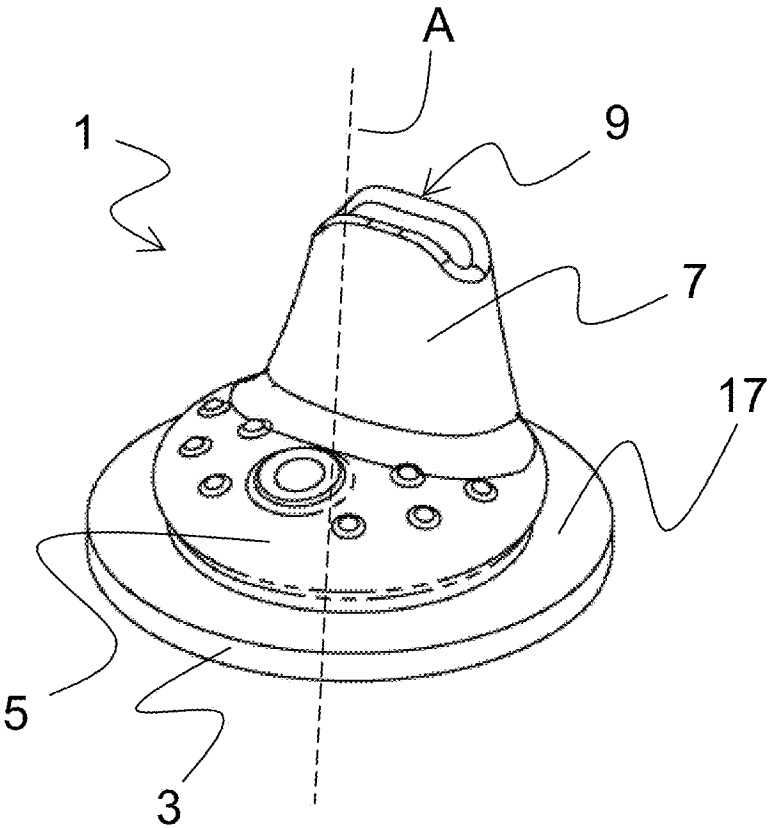
FIG. 1 is a perspective view of a first embodiment of a drinking spout.
Figure 2:
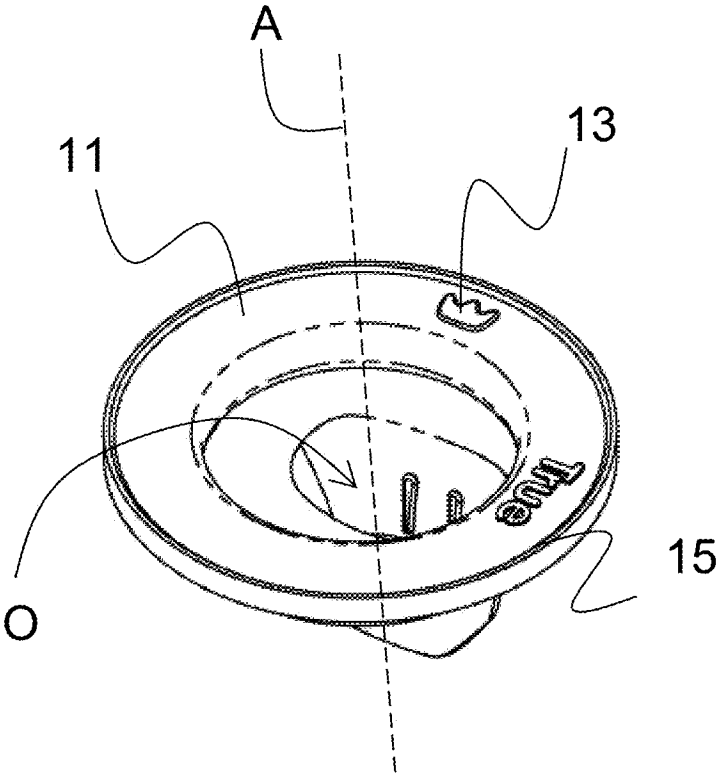
FIG. 2 is a perspective view of the underside of the first embodiment of the drinking spout of FIG. 1.

A spout 1 for drinking vessels is shown in FIG. 1 having a flange 3, an intermediate portion 5, an upper fluid conduit 7 and a spout tip 9 generally formed about a main axis A extending through the center of the opening O defined by the flange 3. The flange 3 features a circumferential radial extending lower sealing surface 11 and upper sealing surface 17 that provides an area for mounting of the spout 1 onto a cup or bottle using a snap or threaded annular cap (not shown). The lower sealing surface 11 as shown in FIG. 2 may have one or more orientation indictors or keys 13 providing for proper alignment of the spout or suction portion 7 with one or more features, for example gripping features formed in a bottle or cup, such as alignment with a handle or topoergonomical gripping surface(s) formed in or on the cap, cup or bottle to facilitate a user grasping the cup, cup or bottle and properly orienting the spout 1 to the user's mouth.

The flange 3 may have an axially depending rim 15 to properly seal the spout 1 around and against an opening of the container and also prevent fluids from leaking between the container and the lower sealing surface 11. The upper sealing surface 17 generally seals against an inner surface of the annular cap (not shown) to secure the spout 1 to the container as is generally known in the art. Because such annular cap(s) and this general manner of securing spouts and nipples to containers are known in the art no further discussion regarding the same is provided.

Figure 4:
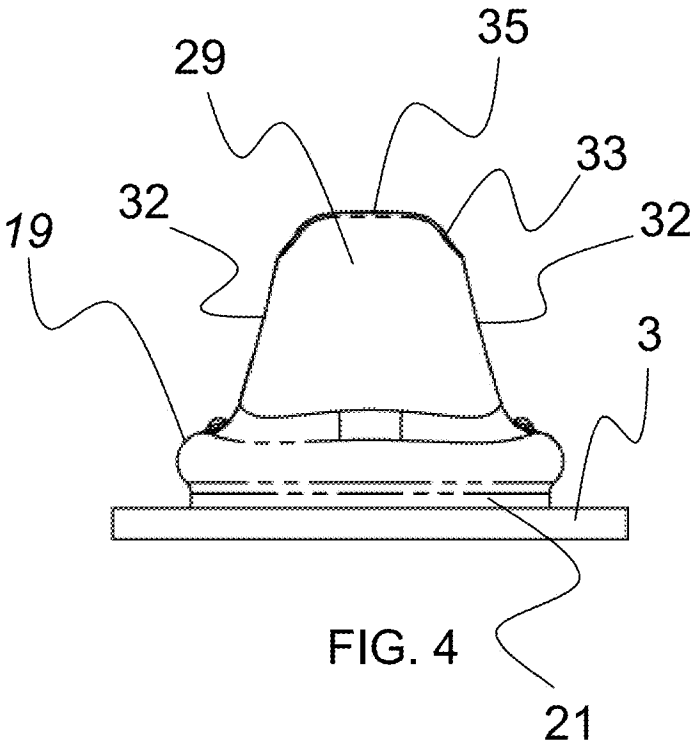
FIG. 4 is a front view of the first embodiment of the drinking spout.
Figure 3:
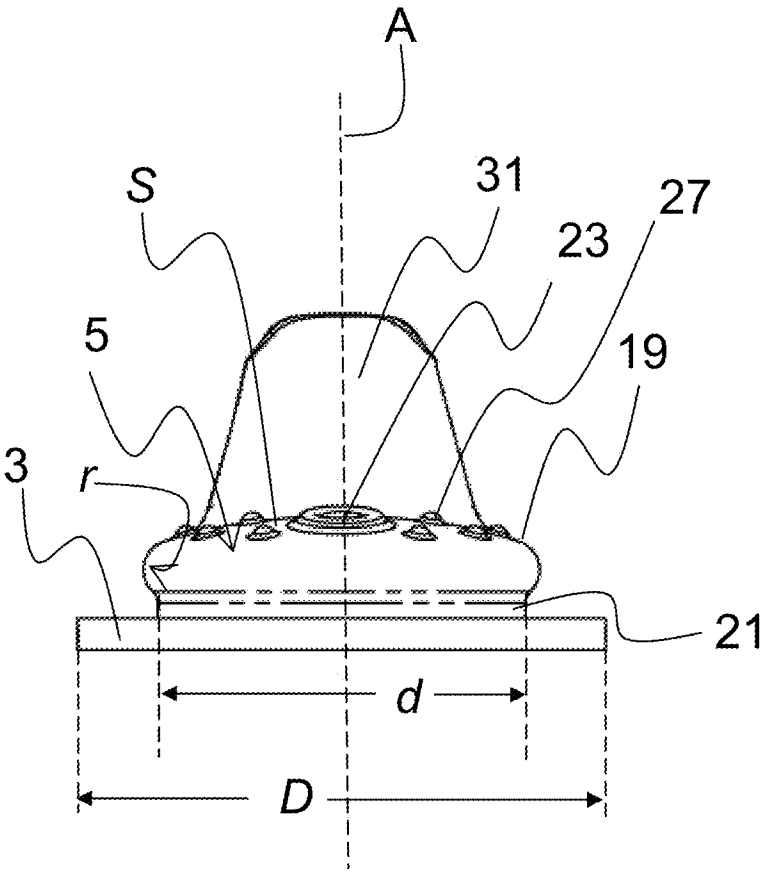
FIG. 3 is a rear view of the first embodiment of the drinking spout.

The intermediate portion 5 is formed having a semi-hemispherical profile, i.e. rounded sidewall as best seen in FIGS. 3, 4. The rounded sidewall 19 has a substantially constant radius of curvature r from an intersection with a circumferential boss 21 which permits a desired standoff spacing between the intermediate portion 5 and the flange 3. The circumferential boss 21 has a diameter d smaller than an outer diameter D of the mounting flange 3 and provides for the thickness of the annular cap when securing the spout 1 to the container.

The rounded sidewall 19 extends from the circumferential boss 21 about its radius of curvature r to an upper intermediate surface S which is slightly domed and intended to flex in an axial manner when a user sucks on the spout. The rounded sidewall 19 essentially acts as a circumferential hinge permitting the upper intermediate surface S to flex axially, i.e. inwards and outwards along the main axis A relative to the container to create suction and/or a vacuum in the container which facilitates the extraction of fluid by the user.

An air flow relief valve 23 for permitting the influx of air into the container as the user withdraws fluid may be formed in the upper intermediate surface S. The valve 23 may be a flap, check or other air flow valve that opens when a vacuum is caused in the container by sufficient suction to provide for the entry of air into the container when the spout is sucked upon. The valve 23 is one which opens to allow air from outside the container and spout 1 to enter the container when the air pressure inside the container is less than that outside the container, due to the user sucking fluid out. This valve remains closed when the spout is not in use to prevent the release of fluid from the container even in a tilted or upside down position. The valve 23 may be formed almost anywhere on the spout 1, but is generally found on the intermediate portion 5 for example on the upper intermediate surface S where it is not likely to be blocked by the users appendages or face while drinking Nubs, protrusions or other surface deformations 27 may also be formed along the upper intermediate surface S to provide for stimulation of an infant's or child's lips and mouth when drinking through the spout 1.

A front profile view of the spout 1 and in particular the fluid conduit 7 and spout tip 9 is shown in FIG. 4 where above the sidewall 19 and surface S the fluid conduit 7 is formed by a substantially vertical front wall 29 which slopes slightly inward, i.e. towards the main axis A, from a connection with the surface S and sidewall 19 and upward toward the spout tip 9. Opposite the front wall is the back wall 31, also substantially vertical but having a slightly more curved slope which merges with the surface S. As best seen for example in FIG. 5 the front wall 29 as well as the back wall 31 are offset from the axis of symmetry A and between them define the tip portion of the spout 1 which includes a fluid flow path P which is similarly offset from the main axis A. This offset provides for the spout 1 to be closer to the container's edge and thus allow for more consistent fluid flow to the fluid conduit 7 from the container, especially when compared to a centrally located spout or nipple. Although designs where the fluid conduit 7 is disposed centrally could also be contemplated.

The front and back walls 29, 31 are slightly nonparallel planes which curve to connect and form the sidewalls 32 of the fluid conduit 7. The front and back walls, along with the sidewalls 32 extend upwards from the intermediate portion 5 of the spout 1 in a tapering manner to meet and form the spout tip 9. It is to be appreciated that the more vertical transition of the front wall 29 and the slower transition curvature of the slope of the back wall 31 facilitates an orthodontically pleasing sensation to the person drinking from the container with the front wall 29 of the spout 1 and helps correctly align the spout 1 in a desired manner relative to the user's lower jaw and upper jaw so that the desired flow rate to the user is attained in every drinking situation.

Figure 6:
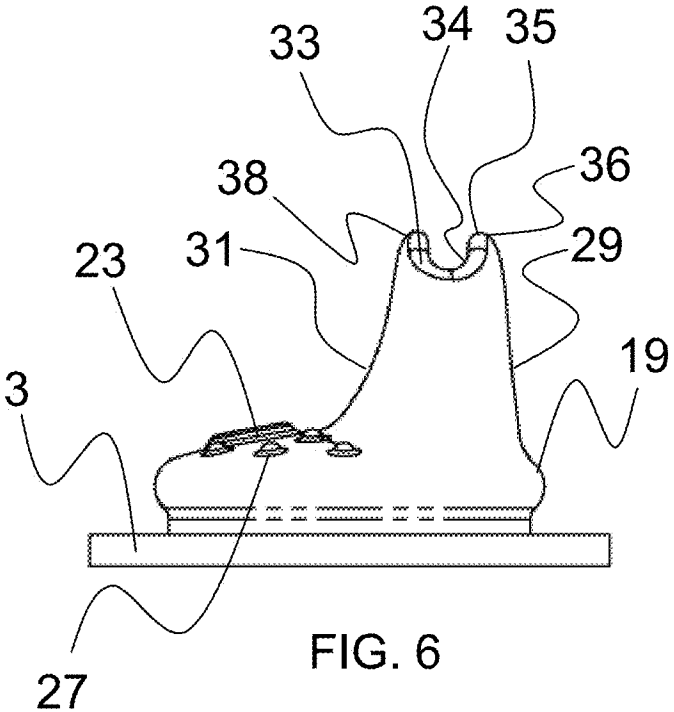
FIG. 6 is a side view of the first embodiment of the drinking spout.
Figure 5:
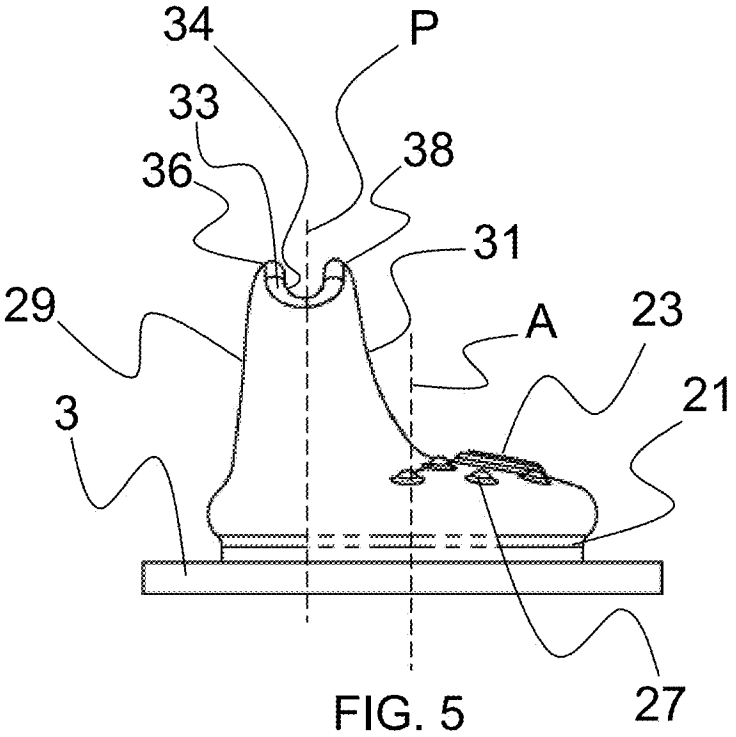
FIG. 5 is a side view the first embodiment of the drinking spout of FIG. 1 showing the offset of the spout from the axis of symmetry.

An important aspect of the present invention is the construct of the spout tip 9 as best observed in FIGS. 5 and 6. The front and back walls 29 and 31 extend axially higher than the sidewalls 32 which, from the side as shown here, gives the tip 9 a distinct U-shaped valley formation which when viewed from the side is similar to the topography left by retreating glaciers. The outer edge or lip 35, of this U-shaped valley essentially defines a mouth of the spout tip 9. The lip 35 in the perspective view of FIG. 1 has a front edge 36 and back edge 38 respectively correlating to the front and back walls 29 and 31. Between the front and back edges 36, 38, the lip 35 curves axially downward as it extends towards the sidewalls 32 of the fluid conduit 7 to form the corner edges 33 of the mouth. An inner wall 34 of the U-shaped valley leads down from the circumferential lip 35 to a bottom wall or barrier 39 which forms the U-shaped valley.

Figure 8:
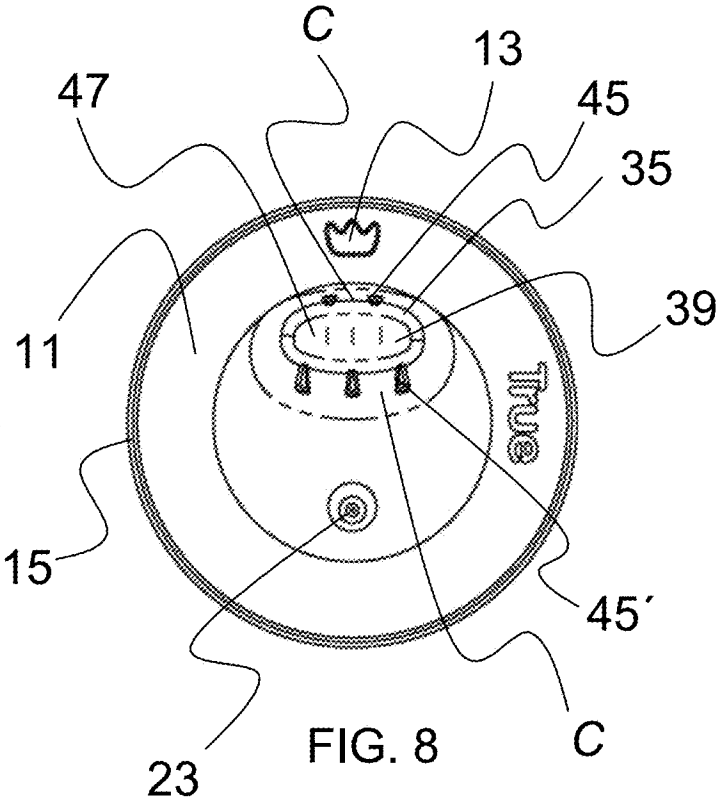
FIG. 8 is a bottom view of the first embodiment of the drinking spout.
Figure 7:
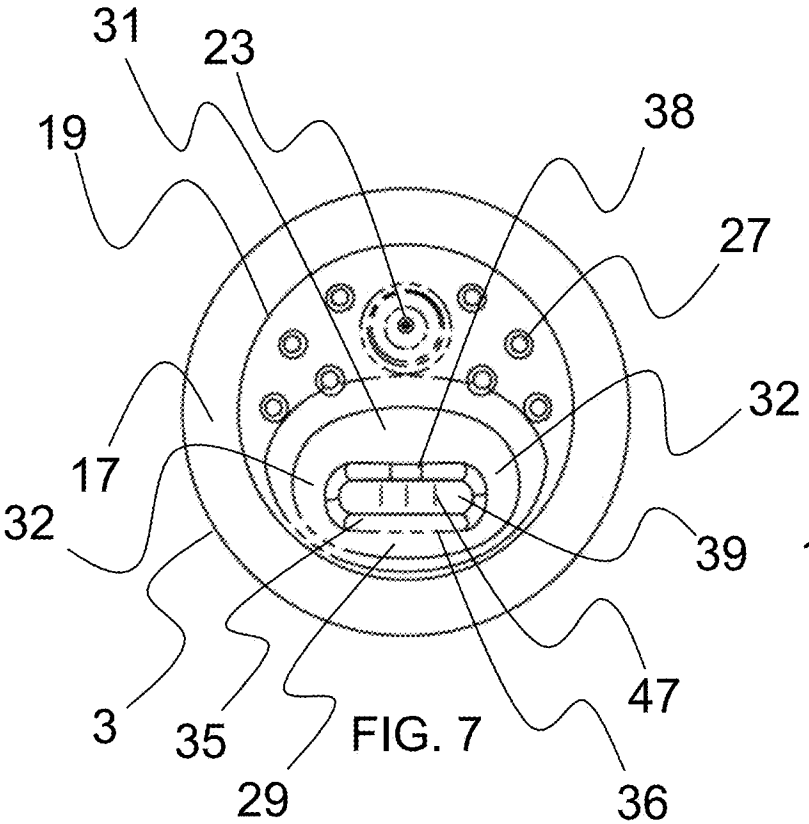
FIG. 7 is a top view of the first embodiment of the drinking spout.
Figure 10:
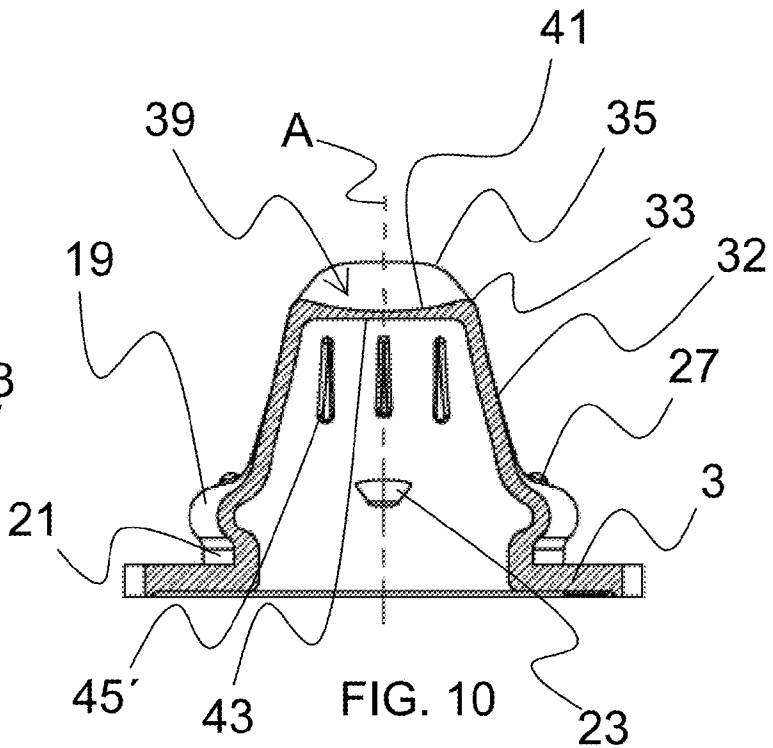
FIG. 10 is a cross-sectional rear view of the first embodiment of the drinking spout.
Figure 9:
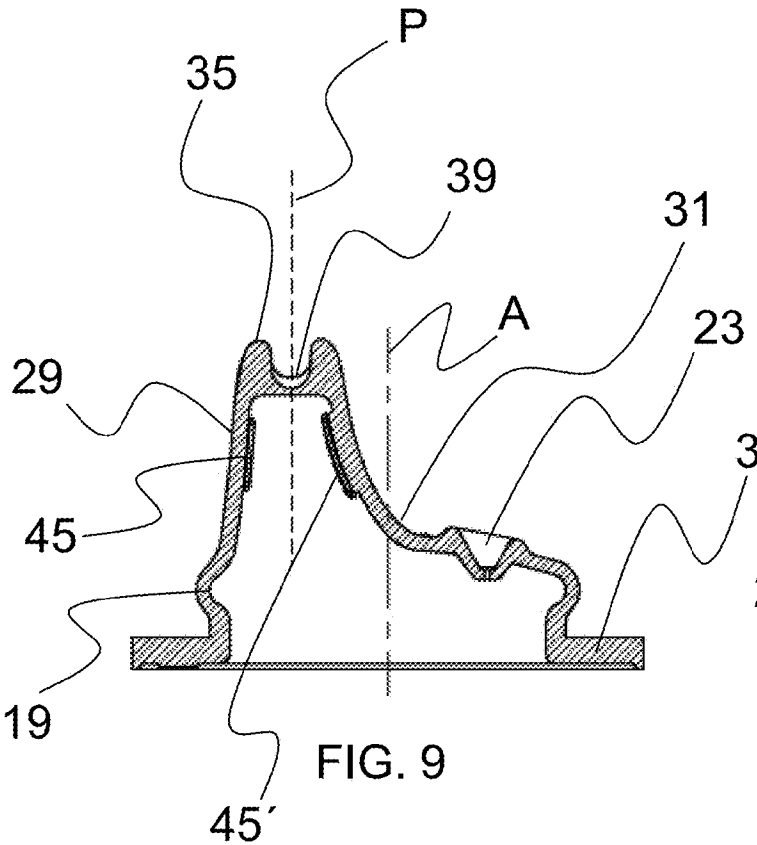
FIG. 9 is a cross-sectional side view of the first embodiment of the drinking spout.

The lip 35 is shown in the plan views of FIGS. 7 and 8 in a semi-elliptical shape with the front and back edges 36, 38 of the lip 35 being substantially linear, although they could be curved as well in a more elliptical shape. The corner edges 33 of the mouth could be other shapes as well i.e. a sharper curve or even an angular corner as long as the mouth maintains a generally semi-elliptical or elongate shape mimicking to some extent a user's mouth. The bottom wall 39 as seen in FIGS. 9 and 10 has an upper surface 41 provided with a slight concavity to the upper surface 41, and a lower surface 43 which is a substantially planar surface. One or more slits 47 are formed in the bottom wall 39 to provide for fluid flow from the container as described in further detail below. One or more stability ribs 45 are formed in the surface of the front and back walls 29, 31. The ribs 45 and slits 47 as shown in FIGS. 7 and 8 are formed substantially perpendicular to the front and back edges 36, 38 of the lip 35, and as will be discussed in further detail below, this arrangement in combination with the higher extending front and back walls 29, 31 of the fluid conduit 7 provides for highly efficient opening, closing and respective fluid flow and retention by the spout 1.

The additional height and surface area of the front and back walls 29, 31 and respectively the front and back edges 36, 38, of the spout above the bottom wall 39 provides additional leverage when the user places the spout 1 in their mouth and is extracting fluid through the spout 1. The additional leverage caused by the structure of the higher front and back walls 29, 31 can cause a relative increase to the deformation of the bottom wall 39. When a user inserts the spout 1 into their mouth and sucks on the spout, the user's lips and/or teeth press on an intermediate portion of the outer wall of the fluid conduit 7. The intermediate portion against which the lips and/or teeth directly press is generally in the same vicinity but on the outside surface of the spout 1, as the stability ribs 45. This compresses the intermediate portion of the outer wall of the fluid conduit which in turn causes a deformation in the bottom wall 39 in which the slits 47 are formed. This deformation aids in the appropriate opening of the slits 47, which in turn as they open form fluid passages through the bottom wall 39 so that fluid therein is provided to the user. Contemporaneously, the suction applied by the user also directly facilitates the deformation of the bottom wall 39 and the opening of the slits 47 as well. An important aspect of the present invention is that the additional height and surface area created by the front and back walls 29, 31 above the bottom wall 39 adds a third force and effect which facilities deformation of the bottom wall 39 and opening of the slits 47. With the users lips and/or teeth compressing the front and back walls 29, 31 at the intermediate portion of the fluid conduit 7 below the bottom wall, i.e. moving the walls 29, 31 slightly inwards, radially with respect to a fluid flow along axis P, the fulcrum created by the bottom wall 39 at an intersection with the front and back walls 29, 31 tends to allow the front and back walls 29, 31 to bend about this intersection with the higher portion of the front and back walls 29, 31 above the bottom wall 39 moving radially and axially upwards and outwards about the intersection. This radial and axial movement of the higher portion of the front and back walls 29, 31 is also directly facilitated by the suction pressure created by the user on the higher and increased surface areas of the front and back walls 29, 31 extending above the bottom wall 39. Generally the higher portion of the front and back walls 29, 31 is not contacted, or at least not directly compressed by the users teeth, gums or lips and thus this portion of the front and back walls is influenced only by the suction created by the user. In this way deformation stress is being applied along the bottom wall 39 to open the slits 47 from the front and back wall portion axially below the intersection, as well as from the front and back wall portion above the intersection with the bottom wall 39.

It is also important that the U-shaped lip 35 of the mouth as best seen in the perspective view of FIG. 1 and the cut-away views of FIGS. 9 and 10 is higher along the front and back walls 29, 31 above the intersection with the bottom wall 39 and then curves axially downward as it extends towards the corner edges 33 of the mouth. The corner edges 33 are substantially lower than the front and back wall edges 36, 38 and run down almost to the same planar level as the bottom wall 39. Because of these dips in the lip 35 structure there is essentially a lack of material between the portions of the front and back walls 29, 31 located above the bottom wall 39 and thus each of the front and back wall portions are permitted to flex independently of one another and cause deformation of the bottom wall 39 independent of what the opposing front or back wall is doing. Again, this is important in the context of permitting a desired amount of liquid flow during drinking operations by a user. And, when not in use, ensuring that there is little to no leakage of fluid through the spout 1.

The importance of the above discussed structure is that with more deformation effects and forces applied to the bottom wall 39 to open the slits 47 and permit fluid passage, the wider the fluid passages will open. It is important to keep in mind that generally manufacturers would like to make the smallest slits, punctures or openings in the spout for passage of fluid so that when the spout is at rest or not being applied to a user's mouth, the likelihood of leakage is significantly reduced. Where several forces can be applied in unison without increasing the work done by the user based on the structure as discussed above, these forces more easily open the slits 47 to a wider position to allow greater fluid flow. Consequently, this therefore allows a smaller slit, or slits, to be used in the bottom wall 39 than would normally be possible with a conventional spout or nipple tip.

Turning to FIGS. 9 and 10 it is to be appreciated that because the spout is essentially a one-piece molded spout an inside surface of the soft spout 1 correlates to each of the above described outside surfaces of the spout 1. The inside surface of the fluid conduit 7 essentially mimics the same surface curvature, structure and dimensions as the outside surface of the fluid conduit. One important difference is the incorporation of stability ribs 45 which are provided on the inside surface of the fluid conduit 7. The stability ribs 45 are shown here as substantially vertical ribs running up the inside surface of the fluid conduit 7 and perform two functions; specifically ensuring that fluid flow through the fluid conduit 7 remains as laminar as possible, and secondly, keep the fluid conduit 7 from collapsing if a high amount of suction, or mastication is provided by the user. Because the spout 1 is generally made from a soft, fairly flexible material such as silicone, the spout is particularly malleable and deformable with the pressure differential between the inside of the container/spout and the outside, the outside being generally ambient air pressure of course.

The stability ribs 45 extend substantially along the entire axial length of the fluid conduit 7 and protrude from the inner surface of the spout at a height of between about 1-5 mm and preferably about 2-3 mm. The ribs 45 are spaced apart along each opposing wall so that a space or channel C is formed between each adjacent rib 45. The channel is important because it allows an oppositely positioned rib 45' on the opposing inside surface of the fluid conduit 7 to pass into this space or channel while not interfering with the opposing ribs 45. This structure thus offsets the ribs 45 and 45' so that in an extreme collapsed state of the fluid conduit 7 the ribs 45, 45' essentially inter-mesh between one another, but prevent the complete collapse of the opposing inside surfaces of the fluid conduit 7 against one another. In other words, the stability ribs 45 create a standoff distance so that the walls of the fluid conduit 7 cannot entirely collapse and block fluid flow through the fluid conduit 7 even where a user has mashed down with their teeth or jaws on the fluid conduit 7 of the spout 1.

The offset of the ribs 45 and 45' is best seen in FIG. 8 where one side of the fluid conduit has two ribs 45, and the opposing side has three ribs 45'. As can be seen here the two ribs 45 are oppositely disposed from the channels C defined between the three ribs 45' so that if the surfaces of the front wall 29, and of the back wall 31 of the fluid conduit are compressed the interspaced, oppositely disposed ribs on the inside surface of the fluid maintain a standoff, and therefore a passage, essentially equal to the height of the ribs which allows fluid to continue to flow axially between the ribs through the spout 1 to the user.

Without such over-compression, the ribs 45 and 45' and the respective walls of the fluid conduit 7 are maintained in a normally spaced apart position because of the elasticity of the material and resiliency of the surface S and rounded sidewall 19 which can absorb some of the tension in the spout generated by a user when withdrawing fluid through the spout. The rounded surfaces and additional material of the sidewall 19 allow for the compression of the surface S, and resiliency to reform the front and back walls 29, 31 as compression is released assisting in preventing the spout B from being pulled out or away from the annular ring securing the spout 1 to the container. The spout 1 may be formed from a rubber, silicone or other resilient plastic material having appropriate toxicity and other characteristics for a conventional drinking spout.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

While this invention may be embodied in many different forms, there are described in detail above a specific preferred embodiment of the invention. This description is an example(s) of the principles of the invention and is not intended to limit the invention to the particular embodiment. Those skilled in the art may recognize other equivalents to the specific embodiment described herein which equivalents are intended to be encompassed by the claims attached hereto.

What is claimed is:

1. A fluid conduit for drinking containers, comprising:

a flange for attachment to a container;

a domed enclosure having a rounded sidewall extending from the flange and an upper intermediate surface, the rounded sidewall acting as a circumferential hinge permitting the upper intermediate surface to flex;

a first and second sidewall extending from the domed enclosure;

a front wall curved to connect to the first and second sidewall and extending from the domed enclosure, the front wall extending from near an edge of the domed enclosure;

a back wall curved to connect to the first and second sidewall and extending from the domed enclosure, the back wall extending from an offset from a center of the domed enclosure;

a barrier that extends from the first and second sidewalls and intersects with the front wall and the back wall, the barrier having slits;

a lip formed along and around edges of the first and second sidewall, the front wall, and the back wall; and wherein the lip along and around the front and back walls curves axially downwardly to form corner edges that extend to the barrier and form tops of the first and second sidewalls so that portions of the front wall and back wall extend axially higher from the barrier than the tops of the first and second sidewalls extend from the barrier to form a spout tip having a lack of material between the portions of the front and back walls permitting the front and back wall portions to flex independently of one another with an additional height and surface area of the portions of the front and back walls of the spout tip from the barrier providing additional leverage when the user places the spout tip in their mouth and is extracting fluid; and radial and axial movement of the portions of the front and back walls facilitate deformation of the barrier to open the slits.

2. The fluid conduit for drinking containers of claim 1 further comprising at least one stability rib along the front wall and at least one stability rib along the back wall; and wherein the at least one stability rib of the front wall is offset from the at least one stability rib of the back wall.

3. The fluid conduit for drinking containers of claim 1 further comprising a ventilation valve within the domed enclosure.

4. A method of making a fluid conduit for drinking containers, comprising the steps of:

forming a flange for attachment to a container;

extending a domed enclosure from the flange the domed enclosure having a rounded sidewall extending from the flange and an upper intermediate surface, the rounded sidewall acting as a circumferential hinge permitting the upper intermediate surface to flex;

extending a first and second sidewall from the domed enclosure;

extending a front wall from near an edge of the domed enclosure;

forming a lip along tops of the first and a top of second sidewalls and the front wall;

connecting a curve that extends axially downwardly from the front wall to the first and second sidewalls forming corner edges;

extending a back wall from an offset of a center of the domed enclosure;

forming a lip along the tops of the first and a top of second sidewalls and the back wall;

connecting a curve that extends axially downwardly from the back wall to the first and second sidewalls forming corner edges;

extending a barrier from the sidewalls, the barrier having slits and intersecting with the front wall and back wall so that portions of the front wall and back wall extend axially higher from the barrier than from the tops of the first and second sidewalls extend from the barrier;

thereby forming a spout tip having a lack of material between the portions of the front and back walls permitting the front and back wall portions to flex independently of one another with an additional height and surface area of the portions of front and back walls of the spout tip from the barrier providing additional leverage when the user places the spout tip in their mouth and is extracting fluid; and radial and axial movement of the portions of the front and back walls facilitate deformation of the barrier to open the slits.

5. The method of making the fluid conduit for drinking containers of claim 4 further comprising the steps of forming at least one stability rib along the front wall and forming at least one stability rib along the back wall; and wherein the at least one stability rib of the front wall is offset from the at least one stability rib of the back wall.

6. The method of making the fluid conduit for drinking containers of claim 4 further comprising the step of forming a ventilation valve within the domed enclosure.

* * * * *